US010851650B2

(12) United States Patent
Surmont et al.

(10) Patent No.: US 10,851,650 B2
(45) Date of Patent: Dec. 1, 2020

(54) UNCLOGGING OF A DISCHARGE OPENING OF A TUNNEL BORING MACHINE BY ULTRASONIC WAVES

(71) Applicant: BOUYGUES TRAVAUX PUBLICS, Guyancourt (FR)

(72) Inventors: Antoine Thierry Charles Surmont, Voisins-le-Bretonneux (FR); Quentin Marie Christophe Bonnemaison, Bourg la Reine (FR); Pierre-Marie Pascal Tierce, Aix-en-Pevele (FR)

(73) Assignee: BOUYGUES TRAVAUX PUBLICS, Guyancourt (FR)

( * ) Notice: Subject to any disclaimer, the term of this patent is extended or adjusted under 35 U.S.C. 154(b) by 0 days.

(21) Appl. No.: 16/802,281

(22) Filed: Feb. 26, 2020

(65) Prior Publication Data

US 2020/0318478 A1 Oct. 8, 2020

(30) Foreign Application Priority Data

Feb. 27, 2019 (FR) ..... 19 02023

(51) Int. Cl.
*E21D 9/10* (2006.01)
*E21D 9/11* (2006.01)

(52) U.S. Cl.
CPC ..... *E21D 9/1046* (2013.01); *E21D 9/112* (2013.01)

(58) Field of Classification Search
CPC ..... E21D 9/1046
See application file for complete search history.

(56) References Cited

FOREIGN PATENT DOCUMENTS

| | | | |
|---|---|---|---|
| DE | 3003826 | * | 8/1981 |
| EP | 0084365 | * | 7/1983 |
| JP | 64-052995 A | | 3/1989 |
| JP | 2694856 | * | 12/1997 |
| JP | 10-317891 | * | 12/1998 |
| JP | 2009-228261 | * | 10/2009 |

OTHER PUBLICATIONS

Preliminary Research Report received for French Application No. 1902023, dated Jan. 8, 2020, 5 pages (1 page of French Translation Cover Sheet and 4 pages of original document).

* cited by examiner

*Primary Examiner* — Sunil Singh
(74) *Attorney, Agent, or Firm* — Womble Bond Dickinson (US) LLP

(57) ABSTRACT

The invention relates to a cutting wheel of a tunnel boring machine comprising at least one material discharge opening (5), said discharge opening (5) being delimited by a circumferential wall (10), the cutting wheel (3) being characterized in that it further comprises at least one ultrasonic emitter (6) configured to generate a mechanical vibratory motion in a range of ultrasonic frequencies, said emitter (6) being fixed against the circumferential wall (10) so as to transmit the mechanical vibratory motion to the vibrating circumferential wall (10) and to reduce its coefficient of friction.

13 Claims, 2 Drawing Sheets

[Fig. 1]
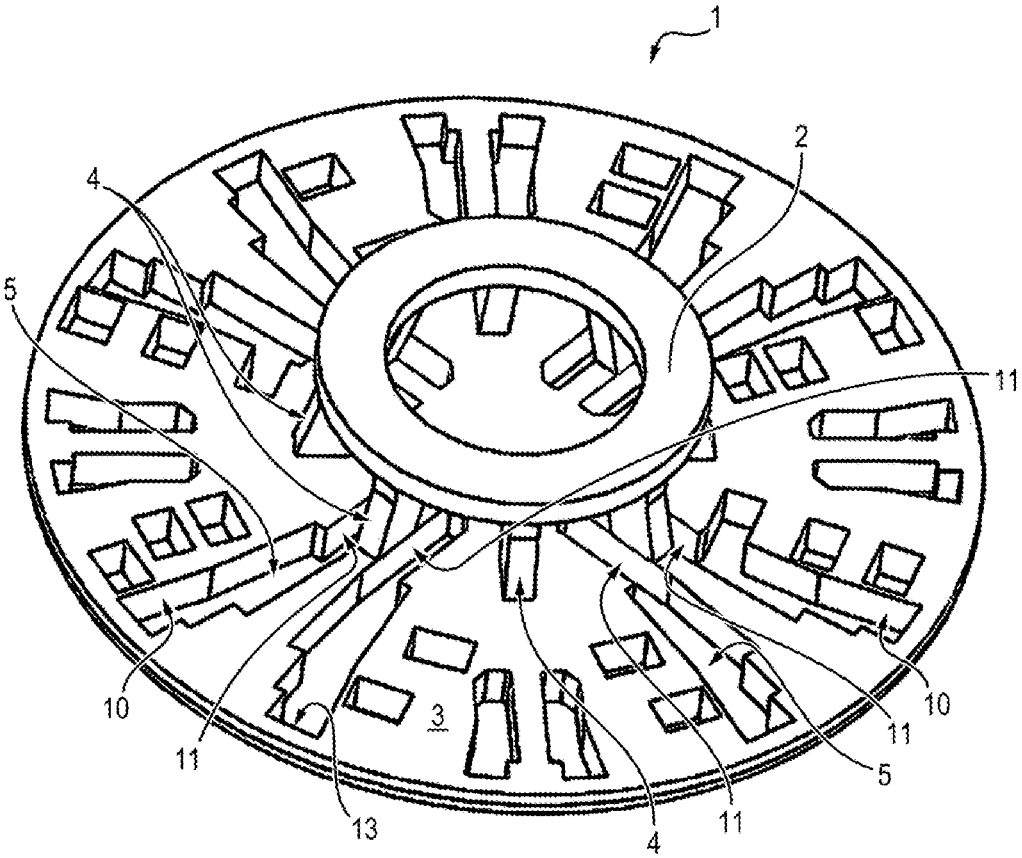
[Fig. 2]
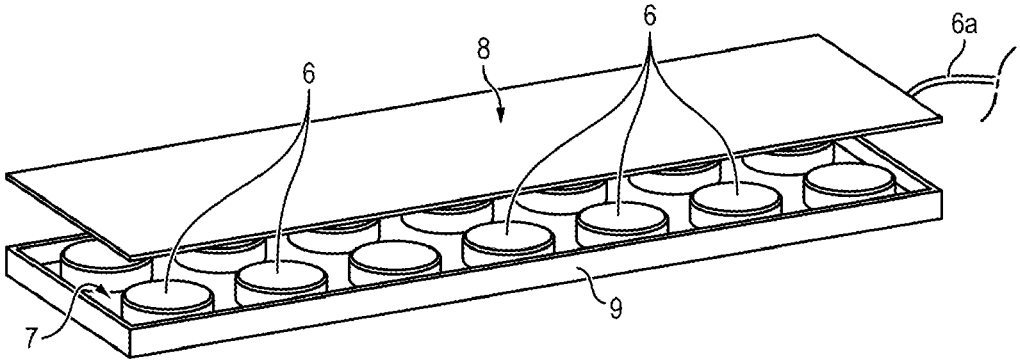

[Fig. 3]
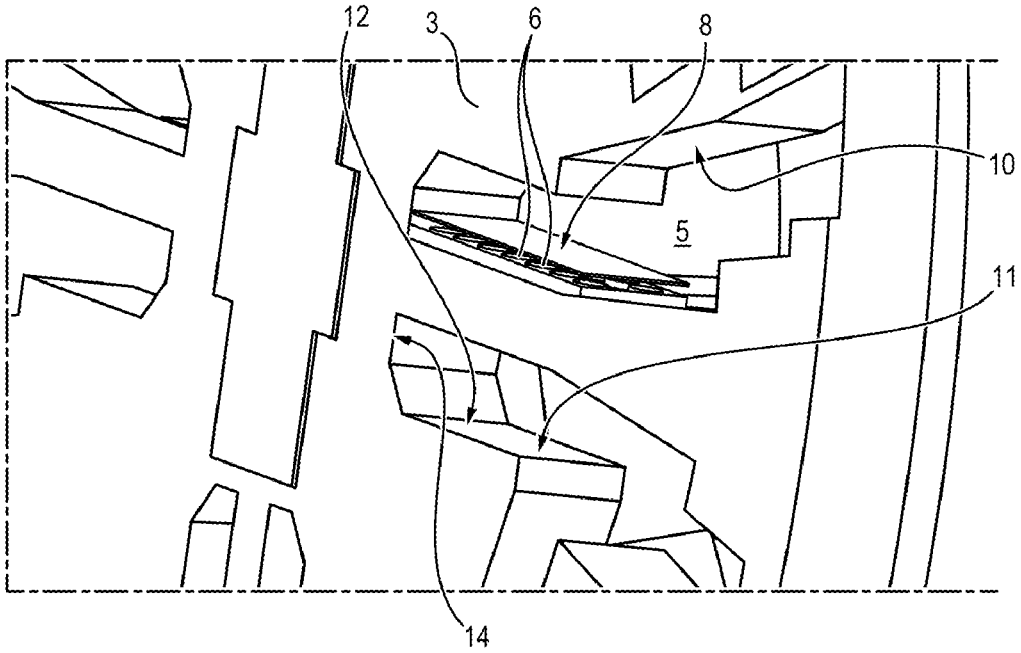

UNCLOGGING OF A DISCHARGE OPENING OF A TUNNEL BORING MACHINE BY ULTRASONIC WAVES

FIELD OF THE INVENTION

The invention generally relates to the field of mechanized underground works, more particularly to the excavation using a digging machine of the tunnel boring machine type. More specifically, the invention focuses here on the clogging or blocking of the discharge openings of the cutting wheel of a tunnel boring machine allowing the passage of the materials towards the extraction chamber behind the cutting wheel.

TECHNOLOGICAL BACKGROUND

Tunneling machines called tunnel boring machines are known, which include a movable structure with large dimensions consisting of a large mobile plant at the front of which is disposed a shield having a section in line with the final shape of the tunnel (tunnel of circular section, bilobed tunnel, etc.).

The front part of the shield which comes into contact with the working face to make the cutting of the geological formation traversed by the tunnel includes a cutting wheel supporting work tools and driven in rotation at a determined speed which depends on the nature of the ground to dig.

The cutting wheel of a tunnel boring machine can be obstructed or blocked when the ground encountered at the cutting face comprises materials with high plasticity generally due to the presence of clay, and when the conditioning provided by the construction site (additives) is not sufficient to facilitate the discharge of these materials. The accumulation of the material eventually results in the clogging of the openings provided for the discharge of the ground, which has the effect of preventing the advance of the machine.

Currently, the discharge openings must be unblocked using high-pressure water jets or manual tools (pickaxe or shovel), which involves sending staff behind the cutting wheel, namely in a hyperbaric atmosphere and at a high temperature. This operation therefore requires time and presents a significant risk for the health and safety of the staff.

It has therefore already been proposed to act on the geometry ("fruit", or inclination of the walls) and the coating of the discharge openings formed in the cutting wheel in order to facilitate as much as possible the discharge of the ground and to reduce the risks of clogging or blocking. However, these means do not completely prevent the clogging.

Document JP 2009-228261 has also proposed, in the case of a tunnel boring machine comprising a rotating wall, to inject high-pressure water and to generate ultrasonic vibrations in the ground using emitters placed on the rotating wall of the tunnel boring machine. In this way, the ground which stagnates about the axis of rotation of the tunnel boring machine is moved, which allows reducing the risks of blocking of the rotating wall.

Document JP 64052995, for its part, proposes to reduce the clogging of the extraction chamber of a tunnel boring machine by generating sound waves in the ground. The transmission of the vibrations has the effect of moving the ground and thus limiting the clogging.

In these two documents, the ultrasonic emitters are mounted on silent-blocks in order to prevent the propagation of the vibrations towards the frame of the tunnel boring machine and to maximize the transmission of the waves to the ground, thus improving the movement of the ground. In addition, the clogging of the ground is treated at the chamber which is located downstream of the cutting wheel and whose volume is greater than the discharge openings, which allows moving the ground sufficiently to unclog it. However, such a movement cannot be obtained in the case of a discharge opening.

SUMMARY OF THE INVENTION

An objective of the invention is therefore to propose a new solution that can be applied to the unclogging of the discharge openings of the cutting wheel of a tunnel boring machine, and that allows limiting or even eliminating the risks of clogging and blocking of said openings even when the ground comprises materials with high plasticity such as clay. Advantageously, this solution can be adapted to any type and any size of tunnel boring machine.

For this, the invention proposes a cutting wheel of a tunnel boring machine comprising at least one material discharge opening, said discharge opening being delimited by a circumferential wall, the cutting wheel being characterized in that it further comprises at least one ultrasonic emitter configured to generate a mechanical vibratory motion in a range of ultrasonic frequencies, said emitter being fixed against the circumferential wall so as to transmit the mechanical vibratory motion to the vibrating circumferential wall and to reduce its coefficient of friction.

Some preferred but non-limiting characteristics of the cutting wheel described above are the following, taken individually or in combination:

- the ultrasonic emitter is fixed directly to the circumferential wall.
- the ultrasonic emitter is fixed to a plate, said plate being added and fixed directly to the circumferential wall.
- a groove is formed in the plate so as to locally reduce its thickness and the emitter is housed at least partially in the groove.
- at least one emitter is configured to generate a mechanical vibratory motion in a range of frequencies comprised between 16 kHz and 25 kHz, preferably on the order of 19 kHz.
- at least two ultrasonic emitters, preferably between four and ten ultrasonic emitters, are fixed to the circumferential wall of the discharge opening.
- the ultrasonic emitters are configured to generate a mechanical vibratory motion in a range at the same ultrasonic frequency, to within 1%.
- the circumferential wall of the opening has two radial walls, extending radially from a center of rotation of the cutting wheel, and two side walls connecting the radial walls, the at least one emitter being fixed to one of the radial walls.
- the radial wall to which the emitter is fixed has an inner edge, close to the axis of rotation of the cutting wheel, and an outer edge, at a distance from the axis of rotation of the cutting wheel, the radial wall having a determined length between the inner edge and the outer edge, and the emitter is fixed at a distance from the inner edge comprised between 5% and 50% of the predetermined length.

According to a second aspect, the invention proposes a cutting head of a tunnel boring machine comprising a cutting wheel as described above and a fixing ring, the fixing ring and the cutting wheel being joined by a series of arms.

Optionally, the at least one emitter is fixed to the circumferential wall between two adjacent arms.

BRIEF DESCRIPTION OF THE DRAWINGS

Other characteristics, aims and advantages of the present invention will become more apparent upon reading the following detailed description, and in relation to the appended drawings given by way of non-limiting examples and wherein:

FIG. 1 is a partial view of an exemplary embodiment of a cutting head comprising a cutting wheel according to the invention.

FIG. 2 is an exemplary embodiment of an emission system comprising a plate, a cover and ultrasonic emitters which can be used in the cutting head of FIG. 1.

FIG. 3 is a perspective and detailed view of the cutting wheel of FIG. 1 on which the emission system of FIG. 2 has been represented.

DETAILED DESCRIPTION OF ONE EMBODIMENT

Conventionally, a tunnel boring machine comprises, in the front part, a shield having a substantially circular section whose diameter corresponds to the diameter of the tunnel which is dug. The shield houses a cutting head 1 which comes into contact with the working face to dig the tunnel and which is movable in rotation about an axis.

The tunnel boring machine further includes a back-up train extending behind the shield and which advances at the same time as the cutting head 1 during the digging of the tunnel.

In the present application, the upstream and downstream are defined with respect to the direction of discharge of the mud through the cutting head of the tunnel boring machine, along the axis X. Furthermore, in a manner known per se, the axial direction corresponds to the direction of the axis of rotation of the cutting head and a radial direction is a direction perpendicular to this axis and passing therethrough. The lateral direction corresponds to a direction perpendicular to the axis and not passing therethrough.

One example of a cutting head 1 has been illustrated in FIG. 1. The cutting head 1 comprises particularly a fixing ring 2 configured to cooperate with bearings allowing the rotation of the cutting wheel 3 about the axis and a cutting wheel 3 carrying a set of cutting tool-holders and discharge openings 5. The cutting wheel 3 is joined to the fixing ring 2 in a fixed and secured manner by a plurality of arms 4, which extend axially between the rear face of the cutting wheel 3 and the fixing ring 2.

The space delimited by the cutting wheel 3 and the fixing ring 2 within the shield defines a containment chamber. The fixing ring 2, the cutting wheel 3 and the axis are coaxial.

The cutting wheel 3 includes a disc in which a plurality of through passages is formed. The front face of the disc comes into contact with the cutting face while its rear face extends opposite the containment chamber. The through passages form either housings configured to receive a cutting tool-holder and a thumbwheel, or discharge openings 5 configured to discharge the ground dug by the thumbwheels. The discharge openings 5 are then connected to discharge pipes passing through the containment chamber and configured to bring the ground in the rear part of the shield, towards the back-up train, where the ground is then treated.

The containment chamber therefore extends downstream of the rear face of the cutting wheel 3 and the discharge openings 5 open into this containment chamber.

Each discharge opening 5 extends axially through the cutting wheel 3 and is delimited by a circumferential wall 10, that is to say a closed wall extending between the front face and the rear face of the cutting wheel 3. This circumferential wall 10 is therefore in contact with the ground to be discharged.

In order to prevent the discharge openings 5 from being obstructed or blocked by the ground to be discharged, the cutting wheel 3 comprises at least one, preferably several, ultrasonic emitters 6, each ultrasonic emitter 6 being configured to generate a mechanical vibratory motion in a range of ultrasonic frequencies. The emitter 6 is fixed against the circumferential wall 10 so as to transmit the mechanical vibratory motion to the vibrating circumferential wall 10 and to reduce its coefficient of friction. In this way, when the ground comprises materials with high plasticity generally due to the presence of clay, the emission of very high-frequency sound waves (ultrasounds) has the effect of modifying the coefficient of friction of the circumferential wall 10 and sliding the ground on the surface, thus unclogging the discharge opening 5.

By ultrasonic emitter 6, it will be understood here a piezoelectric, electrostrictive or magnetostrictive transducer which is powered by an electric power generator and which allows transforming the electric or electromagnetic energy supplied by the generator into a mechanical vibratory motion in a range of frequencies of the ultrasound field.

The emitters 6 being fixed to the circumferential wall 10, they generate mechanical vibratory motions on the surface of the circumferential wall 10. Unlike the prior art, which seeks to transmit the sound waves to the ground and to prevent them from propagating in the structure of the tunnel boring machine thanks to silent-blocks, the invention therefore proposes to directly load the structure in order to make it vibrate and to reduce its coefficient of friction. It is therefore not a movement of the ground within the discharge openings 5 that allows their unclogging, but an increase in the sliding coefficient of the circumferential wall 10 that allows reducing the adhesion of the ground to the wall and therefore facilitating its discharge.

In a first embodiment, the emitter(s) 6 is/are fixed to the circumferential wall 10 by means of a plate 7, typically a metal plate in order to ensure good transmission of the ultrasonic waves. The plate 7 can then be fixed to the circumferential wall 10 by welding and/or bolting, or any fixing technique capable of withstanding the harsh environment at the cutting face of a tunnel boring machine.

Optionally, a non-through groove is formed in the plate 7, the emitters 6 then being housed at least partially in the groove. The groove thus allows reducing the thickness of the metal plate 7 at the emitters 6 and thus improving the transmission of the ultrasonic waves to the circumferential wall 10.

Alternatively, the emitter(s) 6 can be fixed directly to the circumferential wall 10 that is to say without interface between each emitter 6 and the circumferential wall 10, for example by forming dedicated housings in the circumferential wall 10.

In all cases, it will be noted that the emitters 6 are not fixed to any structures (such as a silent-block) likely to prevent or reduce the transmission of the vibrations generated by the emitter 6 to the structure of the cutting head 1.

Preferably, the emitters 6 are protected from the ground in order to avoid their damage. To this end, the emitters 6 are covered by a cover 8 configured to delimit, with the metal plate 7 or the circumferential wall 10, a generally sealed housing capable of withstanding the harsh environment at the cutting face (hyperbaric atmosphere, abrasive ground, high temperature of the ground).

In the exemplary embodiment illustrated in FIG. 2, the cover has a cover plate of dimensions and shape that are generally complementary to the plate 7 and a border 9 extending from the cover plate whose height corresponds substantially to that of the emitters 6. Preferably, the thickness of the present cover plate should not be too large to guarantee good transmission of the vibrations to the surface in contact with the ground.

Alternatively, as illustrated in FIG. 2, the border 9 can be secured to or formed integrally and in one piece with the metal plate 7.

A single cover 8 and a single plate 7 can be used to house several emitters 6 (see FIGS. 2 and 3).

Each emitter 6 is connected to an electric power generator by means of an electric cable 6*a*. The electric generator is itself controlled by a processing unit adapted to automatically or manually execute the method for unclogging the discharge opening 5, for example a computer (which can be housed in the cab of the tunnel boring machine or remote and connected in a wired manner to this tunnel boring machine). Thus, the processing unit can for example comprise a memory in which the code instructions for the execution of the unclogging method are stored and a computer like a processor, microprocessor, microcontroller, etc., configured to execute said instructions. The computer is further configured to study the behavior of the emitters 6 in order to deduce therefrom the force applied by the ground to the circumferential walls 10 and therefore adapt the frequency and the power to optimize the propagation of the vibrations on said circumferential walls 10. Optionally, the behavior of the emitters 6 can be used to obtain information on the condition of the excavated ground for the driver of the tunnel boring machine.

This processing unit receives as input specific drilling parameters which can comprise measurements obtained by one or several sensor(s) fixed on the tunnel boring machine and giving information on the clogging or blocking of the opening.

In the case where several emitters 6 are fixed to the same circumferential wall 10, all or part of these emitters 6 can be connected in parallel to the same electric generator. The emitters 6 can moreover be configured to generate a mechanical vibratory motion at the same ultrasonic frequency, to within 1%. Alternatively, the frequency of the mechanical vibratory motion of the emitters 6 of the same circumferential wall 10 can be different from one emitter 6 to another in order to adapt the frequency of each emitter 6 to its position on the wall.

The electric power generator is preferably placed behind the cutting head 1, at the level of the back-up train. In this case, in order to join an emitter 6, located at the cutting face, to the corresponding electrical generator, a supply system such as the one described in document EP 1 632 645 in the name of the Applicant can be used. Reference may in particular be made to FIG. 2, which illustrates the fact that the electric cable 6*a* passes at the level of the bearings of the cutting head 1. In one exemplary embodiment, the electrical energy is conveyed from the tunnel boring machine to the cutting wheel 3 by means of an electric rotating collector or electric swivel joint. For example, the tunnel boring machine can for this purpose include a track, joined to a stator part of the tunnel boring machine at the bearings and electrically connected to the electric generator, and a set of metal brushes, electrically connected to the electric cables which power the emitters 6, securely mounted in rotation on the cutting wheel 3 or on the fixing ring 2 so as to rotate around the track.

For example, the electric generator can be configured to apply a 3 A current and a voltage comprised between 300 V and 400 V.

The ultrasonic emitters 6 are configured to emit ultrasonic waves. By ultrasonic waves, we mean here sonic wave with a frequency comprised between 16 kHz and 25 kHz. This range of frequencies indeed allows causing the vibration of the circumferential wall 10 and modifying the coefficient of friction of the circumferential wall 10 sufficiently to unclog the discharge opening 5. Preferably, the ultrasonic waves are emitted at a frequency on the order of 19 kHz (to within 10%).

The Applicant has noticed that the areas of the discharge openings 5 most affected by the blocking and the clogging correspond to the parts of the circumferential wall 10 of these openings which extend generally between two adjacent arms 4 of the cutting head 1. The emitters 6 are therefore preferably positioned in these parts of the circumferential wall 10 that is to say in the inner radial portion of the discharge openings 5. It is therefore possible not to fix any emitters 6 on the side walls, although this remains possible.

In the present application, the axial direction corresponds to the direction of the axis and a radial direction is a direction perpendicular to this axis and passing therethrough. Furthermore, the lateral direction corresponds to a direction perpendicular to the axis and not passing therethrough. Unless otherwise specified, "inner" and "outer", respectively, are used with reference to a radial direction so that the part or the inner face of an element is closer to the axis than the part or the outer face of the same element.

The circumferential wall 10 comprises, in a manner known per se, two radial walls 11 extending radially from the axis and two side walls 14 connecting together the two radial walls 11. Each radial wall 11 has an inner edge 12, close to the axis of rotation of the cutting wheel 3, and an outer edge 13, at a distance from the axis of rotation of the cutting wheel 3. Finally, each radial wall 11 has a determined length corresponding to the shortest distance between the inner edge and the outer edge. Examples of radial 11 and side 14 walls of openings have been illustrated in FIG. 3.

In order to guarantee that the most sensitive areas to clogging are well treated by the ultrasonic emitters 6, at least one emitter 6 is fixed at a distance from the inner edge 12 comprised between 5% and 50% of the predetermined length.

In one embodiment, all the emitters 6 of a given radial wall 11 can be fixed at a distance from its inner edge 12 comprised between 5% and 50% of the length.

Alternatively, the emitters 6 can be fixed along the entire length of the radial wall 11. When the two radial walls 11 of a given discharge opening 5 are equipped with emitters 6, each group of emitters 6 associated with a given radial wall 11 can be powered by a dedicated electric power generator.

In one embodiment, each radial wall 11 is equipped with at least one ultrasonic emitter 6, preferably with several ultrasonic emitters 6. For example, each radial wall 11 can be equipped with one to five ultrasonic emitters 6 depending on the dimension of the radial wall 11. For example, an ultrasonic emitter 6 can be placed every thirty or forty centimeters along the radial wall 11, at least in the portion of the radial wall 11 which extends at a distance from the inner edge 12 comprised between 5% and 50% of the length of said wall. Thus, for a radial wall 11 having a length on the order of two meters, three ultrasonic emitters 6 can be used.

The Applicant has carried out tests on a test bench comprising a box simulating a discharge opening 5 of a cutting wheel 3 whose circumferential wall 10 comprises two diverging radial walls of about 1 m in length, a side wall of about 0.66 m in length and a side wall of about 1 m in length. Each radial wall of the box was equipped with three ultrasonic emitters 6 aligned and spaced from each other by about 25 cm. The emitters 6 were mounted at the bottom of a single groove arranged in a metal plate 7 which was fixed by bolting to the corresponding radial wall. The box thus formed a reservoir, which was filled with a clogging material comprising clay and water in order to obstruct it. The box was then tilted by 10° to simulate the thrust of the ground using gravity, then ultrasonic waves were generated simultaneously by the six emitters 6 at a frequency of 19 kHz. After one minute, the clogging material had detached from the upper side wall of the box and it took only one minute and a half to unclog the entire box simulating the discharge opening 5. In other words, in one minute and a half, all of the clogging material blocking the reservoir of the box which simulated a discharge opening 5 had left the box.

Additional tests have shown that, by increasing the amount of water in the material, said material became more clogged and the duration of emission of the sound waves to unclog the box could increase up to six minutes.

The assembly formed by the emitters 6, the cover and where appropriate the metal plate 7 can be mounted on the cutting wheel 3 at the factory during its mounting phase or added and fixed to the circumferential wall 10 directly on the construction site.

The invention claimed is:

1. A cutting head of a tunnel boring machine comprising:

a cutting wheel comprising at least one material discharge opening, said at least one material discharge opening being delimited by a circumferential wall, and a fixing ring, the fixing ring and the cutting wheel being joined by a plurality of arms and delimiting together a containment chamber, said containment chamber extending downstream of the at least one material discharge opening, and at least one ultrasonic emitter configured to generate a mechanical vibratory motion in a range of ultrasonic frequencies, wherein the at least one ultrasonic emitter is fixed against the circumferential wall of the at least one material discharge opening so as to transmit the mechanical vibratory motion to the circumferential wall and to reduce a coefficient of friction of the circumferential wall.

2. The cutting head according to claim 1, wherein the at least one ultrasonic emitter is directly fixed to the circumferential wall.

3. The cutting head according to claim 1, wherein the at least one ultrasonic emitter is fixed to a plate, which is directly fixed to the circumferential wall.

4. The cutting head according to claim 3, wherein a groove is formed in the plate so as to locally reduce a thickness of the plate and wherein the at least one emitter is housed at least partially in the groove.

5. The cutting head according to claim 1, wherein the at least one emitter is configured to generate a mechanical vibratory motion in a range of frequencies comprised between 16 kHz and 25 kHz.

6. The cutting head according to claim 1, wherein the at least one ultrasonic emitter comprises two ultrasonic emitters.

7. The cutting head according to claim 6, wherein the two ultrasonic emitters are configured to generate a mechanical vibratory motion in a range at a same ultrasonic frequency, to within 1%.

8. The cutting head according to claim 1, wherein the circumferential wall of the material discharge opening has two radial walls, which extend radially from a center of rotation of the cutting wheel, and two side walls, which connect the two radial walls, the at least one ultrasonic emitter being fixed to one of the two radial walls.

9. The cutting head according to claim 8, wherein the radial wall to which the at least one ultrasonic emitter is fixed has an inner edge, which is close to an axis of rotation of the cutting wheel, and an outer edge, which extends at a distance from the axis of rotation of the cutting wheel, the radial wall to which the at least one ultrasonic emitter is fixed having a determined length between the inner edge and the outer edge, and the at least one ultrasonic emitter being fixed at a distance from the inner edge, which is comprised between 5% and 50% of the determined length.

10. The cutting head according to claim 1, wherein the at least one ultrasonic emitter is fixed to the circumferential wall between two adjacent arms of the plurality of arms.

11. The cutting head according to claim 1, wherein the at least one emitter is configured to generate a mechanical vibratory motion in a range of frequencies comprised of about 19 kHz.

12. The cutting head according to claim 1, wherein the at least one ultrasonic emitter comprises between four and ten ultrasonic emitters.

13. The cutting head according to claim 12, wherein the ultrasonic emitters of the at least one ultrasonic emitter are configured to generate a mechanical vibratory motion in a range at a same ultrasonic frequency, to within 1%.

* * * * *